US008089033B2

(12) United States Patent
Zank et al.

(10) Patent No.: US 8,089,033 B2
(45) Date of Patent: Jan. 3, 2012

(54) POD LAUNCHED UNMANNED AIR VEHICLE

(75) Inventors: Paul A. Zank, Brookline, NH (US); Paul D. Zemany, Amherst, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 383 days.

(21) Appl. No.: 12/214,477

(22) Filed: Jun. 18, 2008

(65) Prior Publication Data

US 2009/0308970 A1 Dec. 17, 2009

Related U.S. Application Data

(60) Provisional application No. 60/936,024, filed on Jun. 18, 2007.

(51) Int. Cl.

| | |
|---|---|
| ***F42B 15/01*** | (2006.01) |
| ***F41G 7/22*** | (2006.01) |
| *F42B 15/00* | (2006.01) |
| *F41G 7/00* | (2006.01) |

(52) U.S. Cl. ..... 244/3.1; 244/3.15; 244/75.1; 244/76 R; 244/175; 244/189; 244/190; 701/200; 701/207; 701/213; 89/1.11; 89/1.8; 455/1; 342/13

(58) Field of Classification Search ..... 244/3.1–3.3, 244/75.1, 76 R, 175, 189, 190; 89/1.11, 89/1.8, 1.813–1.819; 342/13–20; 455/1; 701/1, 3, 200, 207, 213

See application file for complete search history.

(56) References Cited

U.S. PATENT DOCUMENTS

| | | | | | |
|---|---|---|---|---|---|
| 2,398,871 | A * | 4/1946 | Buchal et al. | ..... | 89/1.815 |
| 2,709,947 | A * | 6/1955 | Woods | ..... | 89/1.815 |
| 2,731,885 | A * | 1/1956 | Nolan | ..... | 89/1.815 |
| 2,763,189 | A * | 9/1956 | Grill | ..... | 89/1.817 |
| 2,816,483 | A * | 12/1957 | Johnston | ..... | 89/1.817 |
| 2,844,073 | A * | 7/1958 | Re et al. | ..... | 89/1.817 |
| 2,845,004 | A * | 7/1958 | Johnson | ..... | 89/1.815 |
| 2,958,260 | A * | 11/1960 | Anderson | ..... | 89/1.815 |
| 2,961,197 | A * | 11/1960 | Hertel | ..... | 89/1.8 |
| 2,975,676 | A * | 3/1961 | Butler | ..... | 89/1.815 |
| 4,412,475 | A * | 11/1983 | Hornby | ..... | 89/1.816 |
| 4,475,436 | A * | 10/1984 | Campbell | ..... | 89/1.815 |
| 4,785,710 | A * | 11/1988 | Schofield | ..... | 89/1.815 |
| 6,349,898 | B1 * | 2/2002 | Leonard et al. | ..... | 244/3.15 |
| 7,047,861 | B2 * | 5/2006 | Solomon | ..... | 89/1.11 |

* cited by examiner

*Primary Examiner* — Bernarr Gregory
(74) *Attorney, Agent, or Firm* — Daniel J. Long

(57) ABSTRACT

A method and apparatus for attacking a plurality of dispersed targets are herein presented. In particular, the method and apparatus herein presented allow the user to upload target data onto a pod mounted on a host aircraft. Upon reaching the pre loaded target location, the pod releases a plurality of individually targeted Micro Air Vehicles (MAVs), thereby allowing the user to attack a plurality of dispersed targets from a single aircraft standing off at a significant distance from the target area.

24 Claims, 3 Drawing Sheets

POD LAUNCHED UNMANNED AIR VEHICLE

CROSS-REFERENCE TO RELATED APPLICATION

This application claims rights under 35 U.S.C. §119(e) from U.S. Application Ser. No. 60/936,024 filed Jun. 18, 2007, the contents of which are incorporated herein by reference.

STATEMENT OF GOVERNMENT INTEREST

This invention was made with United States Government support. The United States Government has certain rights in this invention.

BACKGROUND OF THE INVENTION

1. Field of the Invention

The present invention relates to ordnance and more particularly to ordnance applications of unmanned aerial vehicles (UAVs).

2. Brief Description of Prior Developments

In modern warfare, especially in counter terrorism operations, adversaries may tend to dispense their assets. It may, therefore, be necessary to attack a plethora of targets from a single aircraft standing off at a significant distance from the target area.

There is, therefore, a need for an alternate way to attack dispersed targets.

SUMMARY OF INVENTION

The present invention is a method and apparatus for attacking dispersed targets from a single aircraft standing off at a significant distance from the target area. According to this invention, pods of individually targeted UAVs are carried in lieu of a bomb on a conventional bomb rack.

BRIEF DESCRIPTION OF THE DRAWINGS

The present invention is further described with reference to the accompanying drawings wherein.

DETAILED DESCRIPTION OF THE PREFERRED EMBODIMENT

Figure 1:
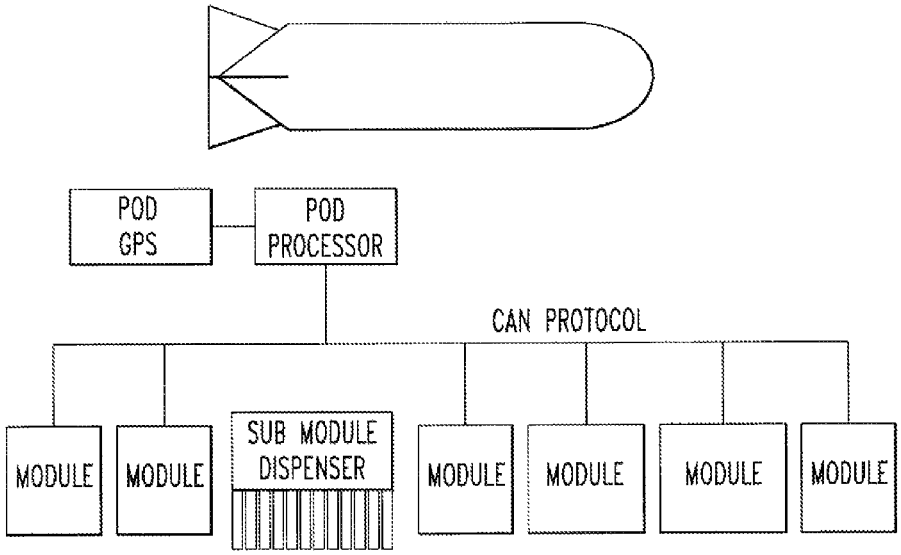
FIG. 1 is a schematic drawing showing a preferred pod for use in the present invention.

Referring to FIG. 1, in a preferred embodiment of this invention pod modules would be ejectable Micro Air Vehicle (MAV) with suitable payloads. The pod modules could also be delivered ballistically with chaff, flares, weapons, or sensors. Fixed modules which stays with the pod may be communications, RF uplink/downlink, and ECM. The pod modules may be single, or double, or triple wide. They may, for example, be 20 single wide modules per pod. It will be appreciated by those skilled in the art that a module to module interlink would be provided by conventional means such as a CAN bus. Other than attachment points, no interface is necessary to the carrying aircraft. The pod has its own GPS and initiates function when the pod enters the preplanned operations area.

Potential MAV payloads would include weapons such as High Explosive utility, armor piercing, anti personnel, anti personnel mines, chemical, and incendiaries. Suitable payloads would also include decoys, or chaff, sensors. Such sensors could include visible light and infra red; acoustic, seismic or magnetic. Other suitable payloads would include chemical weapons or psychological operations devices or materials.

Figure 2:
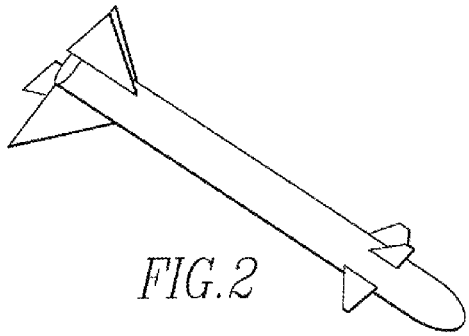
FIG. 2 is a perspective view of an unpowered aerospike for use in the present invention.

Referring to FIG. 2, a maximum vertical velocity Micro Air Vehicle (MAV) is shown which is an unpowered aerospike with a 2:1 length to diameter ratio. Maximum range would be from 10,000 feet AGL ~4 miles. Vz Max would be ~0.8 Mach. The, MAW would drop 10,000 feet AGL in about 20 seconds (straight down) to 120 seconds at 4 miles (maximum range). An example of a suitable payload for use with this embodiment would be a M77 shaped charge.

Figure 3:
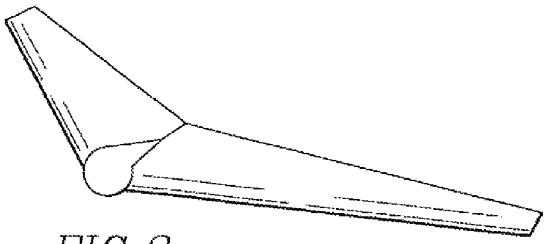
FIG. 3 is a perspective view of a max range/max endurance MAV for use in the present invention.

Referring to FIG. 3, a maximum range/maximum endurance MAV is shown. It would be unpowered and have a 14:1 length to diameter ratio and a range from 10,000 feet AGL ~28 miles. Vz Typical would be ~5 ft/sec (Vh ~80 ft/sec). The MAW would drop 10,000 feet AGL in about ½ hour. An example of a suitable payload would be a jammer.

Delivery modes for the UAV of this invention include endurance glide, fast glide attack, glide and slow drive, glide and fast drive, and unguided ballistic.

Figure 4:
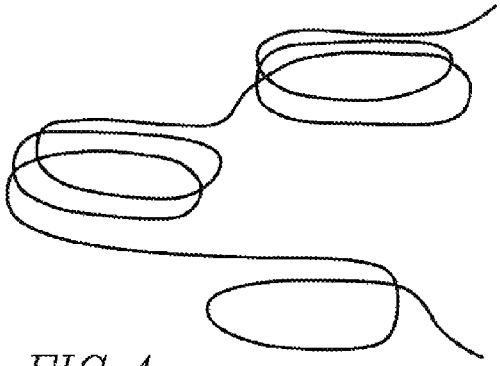
FIG. 4 is a schematic view of an endurance glide trajectory for use in the method of the present invention.

Referring to FIG. 4, in one preferred embodiment of the present invention the UAV may be used in a endurance glide. Typical payloads include sensors, jammers, decoys, and COM crosslink. Guidance might be GPS only or multiple waypoints. Required accuracy would be in hundreds of meters. A special advantage would be that the MAV would achieve programmed waypoints (even in winds) enabling precise geometry between payload and target.

Figure 5:
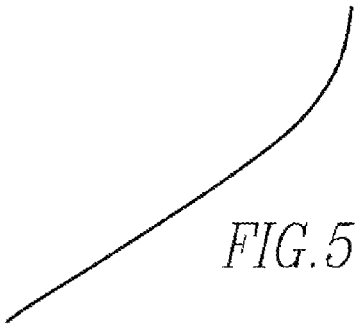
FIG. 5 is a schematic view of a fast glide attack trajectory for use in the method of the present invention.

Referring to FIG. 5, in our alternate embodiment of the present invention, the UAV may be used in a fast glide attack. A typical payload would include weapons. Suitable guidance would be by means of laser designation. The required accuracy would be 1 meter. A special advantage of this embodiment would be that it would be well suited to attack moving targets (car, truck, boat, another UAV) or to attack vertical faces (side of building, cave entrance).

Figure 6:
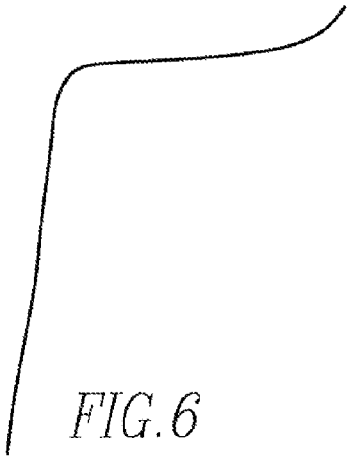
FIG. 6 is a schematic view of a fast glide attack trajectory for use in the method of the present invention.

Referring to FIG. 6, in another alternate embodiment of the present invention, the UAV may be used in a fast glide attack. Typical payloads would include sensors, or weapons such as an M77. Guidance could be by means of GPS glide or GPS and/or laser designator dive. The required accuracy would be 100 m to a meter. Special advantages would be that it could land on roof, camo netting or ground without penetrating. A GPS glide/GPS dive is true fire and forget weapon.

Figure 7:
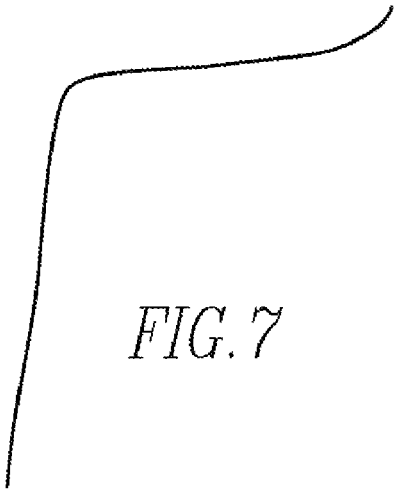
FIG. 7 is a schematic view of a glide and fast dive trajectory for use in the method of the present invention.

Referring to FIG. 7, in another alternate embodiment of the present invention the UAV may be used in a glide and fast dive mode. Typical payloads would include a sensor (such as planting a seismic sensor) or a weapon. Guidance could be GPS guide or laser designator dive. The required accuracy would be from 100 m to 2 m. A special advantage of this embodiment would be that it could penetrate some types of roofs and camo netting. It could also be used in ground attack of moving targets at greater range than fast glide.

Figure 8:
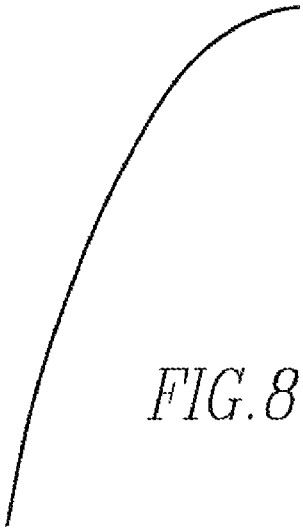
FIG. 8 is a schematic view of a ballistic trajectory for use in the method of the present invention.

Referring to FIG. 8, in another alternate embodiment of the present invention, the UAV could be employed in a ballistic mode. Typical payloads could be an en masse payload such a several dozen M-77's. No guidance would be required. Required accuracy would be 1000 m to 100 m. A special advantage of this embodiment would be its ultra low cost delivery.

Referring to Table 1, a parametric comparison of delivery modes is provided.

TABLE 1

| | Endurance | Fast glide | Glide and slow dive | | Glide and fast dive | ballistic |
|---|---|---|---|---|---|---|
| Guidance | GPS | Laser | GPS | GPS/Laser | GPS/laser | None |
| Accuracy | High | Vary high | High | Very high | Very high | Low |
| Max Range from 10,000 AGL | ~10 nm | ~6 nm | ~8 nm | ~8 nm | ~8 nm | ~1 nm |
| Time in flight (min) | 13 | 6 | 11 | 11 | 10 | 1 |
| Fire and forget | Y | N | Y | N | N | Y |
| Moving Target | N | Y | N | Y? | Y | N |

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A method for attacking a plurality of dispersed targets from a single aircraft, the method comprising:

loading target data directly onto a processor of at least one pod, the pod having at least one attachment point to an aircraft; and dispensing a plurality of individually targeted micro air vehicles (MAVs) from the least one pod upon arrival to the pre-loaded target.

2. The method of claim 1, further comprising feeding the target data from the at least one pod to each of the plurality of individually targeted micro air vehicles (MAVS).

3. The method of claim 1, wherein the target data is loaded into two pods.

4. The method of claim 3, further comprising dispensing at least one of the plurality of individually targeted micro air vehicles (MAVs) from one of the two pods on odd seconds, and dispensing at least another of the plurality of individually targeted micro air vehicles (MAVs) from another of the two pods on even seconds, to avoid flight path conflicts without a pod to pod communication.

5. The method of claim 1, further comprising loading at least one non-ejectable payload into the at least one pod.

6. The method of claim 5, wherein the non-ejectable payload is selected from the group consisting of a jamming device, a flaring device and a chaffing device.

7. The method of claim 1, further comprising jettisoning the at least one pod.

8. The method of claim 1, further comprising prioritizing each of the individually targeted micro air vehicle (MAVs) to allow skipping of at least one of the pre-loaded targets.

9. The method of claim 1, further comprising connecting the at least one pod to a bomb rack of the aircraft.

10. An apparatus for attacking a plurality of dispersed targets from a single aircraft, the apparatus comprising:

at least one pod, wherein the at least one pod has at least one processor for uploading target data directly to the at least one pod, the at least one pod being attached to an aircraft at least one point and the at least one pod having at least one aperture for releasing a payload upon arrival to a pre-loaded target location.

11. The apparatus of claim 10, wherein the payload includes a plurality of individually targeted micro air vehicles (MAVs).

12. The apparatus of claim 11, wherein the plurality of individually targeted micro air vehicles (MAVs) is selected from the group consisting of high explosives weapons, armor piercing weapons, anti-personnel weapons, chemical weapons and incendiary weapons.

13. The apparatus of claim 11, wherein a delivery mode for the plurality of individually targeted micro air vehicles (MAVs) is selected from the group consisting of endurance glide, fast glide attack, glide and slow drive, glide and fast drive, and unguided ballistic.

14. The apparatus of claim 10, wherein at least one item in the payload is non-ejectable.

15. The apparatus of claim 14, wherein the at least one item in the non-ejectable payload is selected from the group consisting of a jamming device, a flaring device and a chaffing device.

16. The apparatus of claim 10, wherein the payload is a M77 shaped charge.

17. The apparatus of claim 10, wherein the at least one pod is fitted with a GPS module.

18. The apparatus of claim 17, wherein the GPS module initiates function when the at least one pod arrives at the pre-loaded target location.

19. A recoverable micro air vehicle (MAV) launched from an unmanned vehicle, the recoverable micro air vehicle (MAV) comprising:

a body, the body having at least one attachment point attaching the body to an unmanned pod, wherein the at least one attachment point is located in a manner such that when the body is detached from the unmanned pod the body undergoes a vertical drop, with respect to a longitudinal axis of the unmanned pod; and a communication module positioned on the body, the communication module receiving target data from the unmanned pod, wherein the communication module guides the recoverable micro air vehicle (MAV) for at least part of a trajectory from the vertical drop to a pre-loaded target location.

20. The recoverable micro air vehicle (MAV) of claim 19, wherein the unmanned pod has at least one attachment point attaching the unmanned pod to an aircraft.

21. The recoverable micro air vehicle (MAV) of claim 19, wherein a delivery mode for the MAV is selected from the group consisting of endurance glide, fast glide attack, glide and slow drive, glide and fast drive, and unguided ballistic.

22. The recoverable micro air vehicle (MAV) of claim 21, further comprising a deployable brake member for reducing flight velocity.

23. The recoverable micro air vehicle (MAV) of claim 22, further comprising a laser designation module for attacking moving targets.

24. The recoverable micro air vehicle (MAV) of claim 23, further comprising a GPS guidance system.

* * * * *